US006889765B1

(12) United States Patent
Traylor

(10) Patent No.: US 6,889,765 B1
(45) **Date of Patent: *May 10, 2005**

(54) SUBMERSIBLE WELL PUMPING SYSTEM WITH IMPROVED FLOW SWITCHING MECHANISM

(75) Inventor: Leland B. Traylor, Draper, UT (US)

(73) Assignee: Smith Lift, Inc., Houston, TX (US)

( * ) Notice: Subject to any disclaimer, the term of this patent is extended or adjusted under 35 U.S.C. 154(b) by 92 days.

This patent is subject to a terminal disclaimer.

(21) Appl. No.: 10/310,186

(22) Filed: Dec. 3, 2002

Related U.S. Application Data

(60) Provisional application No. 60/334,484, filed on Dec. 3, 2001.

(51) Int. Cl.[7] ..... E21B 43/12

(52) U.S. Cl. ..... 166/105.5; 166/65.1; 166/237; 417/368; 417/414; 417/473

(58) Field of Search ..... 166/65.1, 105.5, 166/237; 417/368, 414, 473

(56) References Cited

U.S. PATENT DOCUMENTS

| | | | | |
|---|---|---|---|---|
| 2,435,179 | A * | 1/1948 | McGovney | 166/105 |
| 2,644,401 | A | 7/1953 | Ragland | |
| 2,861,518 | A | 11/1958 | Pleuger | |
| 2,961,966 | A * | 11/1960 | Zillman et al. | 417/390 |
| 3,739,073 | A | 6/1973 | Schneider et al. | |
| 3,749,526 | A | 7/1973 | Ferrentino | |
| 4,346,256 | A | 8/1982 | Hubbard et al. | |
| 4,490,095 | A | 12/1984 | Soderberg | |
| 4,665,281 | A | 5/1987 | Kamis | |
| 4,902,206 | A | 2/1990 | Nakazawa et al. | |
| 5,146,982 | A | 9/1992 | Dinkins | |
| 5,269,377 | A | 12/1993 | Martin | |
| 6,017,198 | A * | 1/2000 | Traylor et al. | 166/105 |
| 6,059,539 | A | 5/2000 | Nyilas et al. | |
| 6,168,388 | B1 | 1/2001 | Hughes et al. | |
| 6,183,217 | B1 | 2/2001 | Elliott et al. | |
| 6,454,010 | B1 | 9/2002 | Thomas et al. | |
| 6,533,039 | B2 | 3/2003 | Rivas et al. | |
| 6,550,535 | B1 | 4/2003 | Traylor | |
| 6,595,280 | B2 * | 7/2003 | Traylor | 166/105.5 |
| 6,722,854 | B2 | 4/2004 | Forsberg | |

* cited by examiner

*Primary Examiner*—David Bagnell
*Assistant Examiner*—Matthew J. Smith
(74) *Attorney, Agent, or Firm*—Conley Rose, P.C.

(57) ABSTRACT

The invention generally concerns a submersible well pumping system comprising an axially elongated housing and a multi-chamber hydraulically driven diaphragm pump suspended in a well. The pump is driven by a self-contained, closed hydraulic system, activated by an electric, pneumatic or hydraulic motor. Several embodiments are used to reverse the flow of working fluid into and out of the working fluid sub-chambers of a two chambered diaphragm pump to operate the diaphragm pump over all operating conditions including starts and stops, and low speed. Generally, the embodiments sense the end of the pumping stroke, either directly or by time. When the end of the pumping stroke is sensed, the direction of flow is reversed by changing the state of a directional valve, operating a reversing clutch, or by deactivating one prime mover-auxiliary pump and activating a second that operates in the reverse direction.

30 Claims, 6 Drawing Sheets

SUBMERSIBLE WELL PUMPING SYSTEM WITH IMPROVED FLOW SWITCHING MECHANISM

CROSS-REFERENCE TO RELATED APPLICATION

I hereby claim the benefit under Title 35, United States Code Section 119(*e*) of any United States Provisional Application(s) listed below:

Application No. 60/334,484

Filing Date: December 3, 2001.

BACKGROUND OF THE INVENTION

1. Technical Field of the Invention

This invention relates generally to submersible well pumping systems. This invention relates particularly to a positive displacement pumping system with an improved, efficient and reliable flow switching mechanism.

2. Description of the Background Art

Hydraulically driven diaphragm pumps are positive displacement pumps that are nearly immune to the effects of sand in the pumped fluid because the pressure generating elements are isolated from the pumped fluid by a flexible diaphragm. In well pump applications, this type of pump is driven by a self contained, closed hydraulic system, activated by an electric or hydraulic motor where the pump, closed hydraulic system, and the motor are enclosed in a common housing and submerged in a well. There are many examples of this type of well pump in the patent literature, but currently none are in use as well pumps because of high cost and/or poor reliability. In well pump applications, the key design feature is the switching mechanism used to redirect or reverse the flow of working fluid from the fluid source, referred to as the auxiliary pump, to the working fluid sub-chambers. The reversal of the flow causes the pumped fluid to move into and out of-pumped fluid sub-chambers through check valves, accomplishing the pumping action.

U.S. Pat. No. 2,435,179 discloses a hydraulically driven diaphragm pump which uses a hydraulically actuated valve to reverse the flow of working fluid. The valve is driven by differential pressure between the fluid inside the working diaphragm (working fluid) and the fluid outside the working diaphragm (pumped fluid). Normally, no differential pressure exists between the two volumes. The pump creates the differential pressure required to reverse the pump by completely filling the diaphragm, causing it to stretch after it is completely full. The amount of pressure generated is limited by the strength of diaphragm material and has the disadvantage of creating diaphragm stress, which can lead to premature diaphragm failure. To maximize diaphragm life, this differential pressure must be limited to the lowest level possible.

The '179 patent uses two sets of diaphragms, one set to control the valve, and the other set to achieve pumping. The pumping diaphragms are located inside the pumping chambers, and the control diaphragms are located between the working fluid inside the pumping chambers and the pump outlet. The external surfaces of the working and control diaphragms are separated by an outlet check valve, creating the possibility that the external pressure would be higher on the control diaphragm due the presence of the checkvalve. If the inlet pressure is higher than the outlet pressure (a common occurrence in well pumps) the pump will not operate and could be damaged. This situation commonly occurs when the pump is installed in a standing fluid column, before fluid has a chance to equalize by flowing through the pump checkvalves. This arrangement also limits the usefulness of the pump by limiting it to use in conjunction with a large diameter liner rather then a more conventional, smaller diameter drop pipe.

A more significant problem occurs in low volume applications. The nature of the pump requires that the hydraulically actuated switch be driven by the same pressure source controlled by the valve, which causes the valve driving force to be released when the valve transverses an intermediate position between states. In low volume applications, the valve can stop in an intermediate position before it has completely reversed the pump. This can cause the pump to either dither (rapid but incomplete movement of the working fluid in one direction), or go into a mode where half the flow is directed into each chamber or stops, which causes the pump to stop functioning. This is especially true during low volume, near equilibrium operations such as those that occur when stopping and starting the pump.

Other problems will occur with the valve setup disclosed in the '179 patent. For example, the control diaphragm is acting directly on a tappet, leading to fluid accumulation between the diaphragm and the tappet, which in turn leads to diaphragm failure unless measures are taken to relieve the fluid. For these and other reasons, the pump described in the 179 patent has never been used in a practical application. This patent application addresses those shortcomings and describes a practical well pump with in improved sensor.

U.S. Pat. No. 2,961,966 discloses another method to reverse the flow of working fluid by reversing the direction of rotation of the electric motor driving the auxiliary pump. That patent discloses a method to sense the differential pressure between the working fluid and the pumped fluid to activate the electrical braking and reversal of the electric motor driving the auxiliary pump. That method also leads to diaphragm stress because differential pressure is required across the diaphragm to actuate the sensor. In addition motor reversal requires very complex electronics. Although theoretically possible, in practice the complexity of that method leads to high expense and unreliable operation due to the difficulty of controlling and reversing the electric motor in a downhole environment.

U.S. Pat. No. 6,017,198 discloses another method to reverse the flow of working fluid, namely the use of sensors and electronics to detect the fact that the diaphragm is full, and reverse the direction of flow by using an electrically actuated valve. This method works very well, but requires relatively complex electronics and a connection into the main power cable. Sealing electronics and power cables against high ambient pressure environments found in wells is expensive and can lead to premature failures of the pump due to high ambient pressure related electrical shorts.

What is needed is a switch that is simple yet reliable, and will not stick in an intermediate position, especially during low volume or start-stop cycles. The most effective switch is a passive hydraulic switch; that is one that derives the power to operate the switch from the flow of hydraulic fluid through the switch. These type switches have proven to be unreliable during low flow and start-stop operations when of conventional design. This application discloses and claims a submersible well pumping apparatus equipped with a reliable flow switch that is either passive hydraulic or contains a minimum of electrical elements.

SUMMARY OF THE INVENTION

The primary pumping system of the invention comprises an axially elongated housing having a diameter less than the bore hole of the well, a pump with a plurality of pumping chambers of fixed volume, each pumping chamber is further subdivided by a flexible diaphragm into two sub-chambers, a working fluid sub-chamber and a pumped fluid sub-chamber, typically made of rubber. Each pumped fluid sub-chamber is connected to the bore hole of the well through a check valve which allows well fluid to flow into the pumped fluid sub-chamber but prevents flow in the reverse direction. Likewise, each pumped fluid sub-chamber is connected through a check valve which allows the well fluid to flow out of the pumped fluid sub-chamber to the pump outlet but prevents flow in the reverse direction. Such an arrangement allows well fluid to flow through the pumped fluid sub-chambers, thereby moving the pumped fluid from the bore hole of the well to the pump outlet and eventually to the surface. The movement of well fluid into and out of the pumped fluid sub-chambers is caused by the insertion or withdrawal of working fluid into and out of the working fluid sub-chambers. The movement of working fluid is caused by a closed hydraulic system that forces working fluid into one or more working fluid sub-chambers while simultaneously withdrawing working fluid from one or more opposite working fluid sub-chambers. Control chambers are used to provide a reference pressure to sense when the working fluid sub-chamber is full by differential pressure, or alternatively, sensors located in the vicinity of the working fluid sub-chambers can be used for this purpose. A flow switch, either hydraulically or electrically powered, is used to control the flow of fluid from the auxiliary pump to the working fluid sub-chambers. The flow switch must completely reverse the flow of working fluid between the working fluid sub-chambers when the pump reaches the end of a stroke, otherwise pump failure will occur. Several embodiments of a more reliable flow switch that is either passive hydraulic or contains a minimum of electrical components are summarized below:

The first embodiment of the flow switch uses check valves and a fixed length timer. This embodiment consists of a closed hydraulic system comprised of an auxiliary pump, a flow switch, a plurality of relief valves, a plurality of control chambers, the working fluid sub-chambers, and passageways. The passageways extend from the auxiliary pump to the flow switch, from the flow switch to the relief valves, and from the flow switch to the working fluid sub-chambers. The control chambers are connected to the relief valves. The auxiliary pump, which can be a piston pump, gear pump, centrifugal pump or any type of pump that produces the required flow rates and pressures, provides inlet and outlet flows of working fluid. The flow switch is connected to the inlet and to the outlet of the auxiliary pump and to two sets of working fluid sub-chambers, each set comprising roughly equal displacement.

The flow switch has two states. In the first state, the inlet of the auxiliary pump is connected to one set of working fluid sub-chambers, and the outlet of the auxiliary pump is connected to the other set of working fluid sub-chambers. In the second state, the flow switch connects the set of working fluid sub-chambers previously connected to the input of the auxiliary pump, to the outlet of the auxiliary pump, and connects the input of the auxiliary pump to the set of working fluid sub-chambers previously connected to the output of the auxiliary pump.

The flow switch is driven between states by either pilot pressure or an electrical signal applied to a solenoid or similar electrical drive device. A timing device that will switch the state of the flow switch at regular intervals controls the application of the electrical or hydraulic control signal to the switch. An electrical or hydraulic timing circuit can generate this regular application of the control signal. Such circuits are well known in the prior art. The timing and amount of working fluid should be adjusted to assure that the working fluid sub-chambers are never fully emptied to avoid excess vacuum at the auxiliary pump. Because the precise amount of fluid in the working fluid sub-chambers cannot be known, there is a high probability that the pump will reach the end of the pumping stroke before the flow switch reverses direction. This is especially true during startup. Under these conditions, the application of excess working fluid into one of the working fluid sub-chambers could cause diaphragm failure.

To prevent this, the pump employs a relief valve for each pumping chamber. The relief valve monitors the pressure differential between the working fluid sub-chamber and the matching control chamber. Normally the pressure differential is near zero. When the working fluid sub-chamber is filled, the pressure differential begins to rise. At a predetermined pressure differential, the relief valve actuates, allowing flow from the working fluid sub-chamber to the low pressure side of the auxiliary pump. In this way, the diaphragms are not damaged while the pump timing is established. After the timing is established, the relief valve is normally not operated, unless an abnormal condition is encountered. After timing is established the flow switch is switched between states by the timing device.

Another embodiment for the flow switch uses a pilot activated two state valve with spring return to reverse the direction of flow in the pump. This pump has a closed hydraulic system comprising an auxiliary pump, a flow switch, a plurality of sensors, a plurality of control chambers, the working fluid sub-chambers, and passageways. The passageways extend from the auxiliary pump to the flow switch, from the flow switch to the sensors, and from the flow switch to the working fluid sub-chambers. The control chambers and the working fluid sub-chambers are connected to the appropriate sensors. The auxiliary pump, which can be a piston pump, gear pump, centrifugal pump or any type of pump that produces the required flow rates and pressures, provides inlet and outlet flows of working fluid. The flow switch is connected to the inlet and to the outlet of the auxiliary pump and to two sets of working fluid sub-chambers, each set comprising roughly equal displacement.

The flow switch has two states. In the first state, the inlet of the auxiliary pump is connected to one set of working fluid sub-chambers, and the outlet of the auxiliary pump is connected to the other set of working fluid sub-chambers. In the second state, the flow switch connects the set of working fluid sub-chambers previously connected to the input of the auxiliary pump, to the outlet of the auxiliary pump, and connects the input of the auxiliary pump to the set of working fluid sub-chambers previously connected to the output of the auxiliary pump.

The flow switch is driven between states by pilot pressure controlled by the sensors. The flow switch has a spring and a pilot port; the spring pushes the valve to the first state, and can be overcome and shifted to the second state by sufficient pilot pressure applied to the pilot port. When the pilot pressure is released, the valve returns to the first state by spring pressure. The sensor will shift when sufficient pressure exists between the working fluid sub-chamber and the matching control chamber. When the sensor on one of the working fluid sub-chambers shifts, it connects the output of the auxiliary pump to the pilot port. The output of the auxiliary pump produces sufficient pressure to shift the flow switch. Once the flow switch has switched, the differential pressure between the working fluid sub-chamber and the matching control chamber is eliminated, the control shifts to the rest position, which is closed, trapping the flow switch in the second state. When the sensor on the opposed working fluid sub-chambers shifts, it connects the input of the auxiliary pump to the pilot port. The input of the auxiliary pump produces is at low pressure and releases the fluid trapped in the pilot port, allowing the flow switch to shift by spring pressure. Once the flow switch has switched, the differential pressure between the working fluid sub-chamber and the matching control chamber is eliminated, the control shifts to the rest position, which is closed, trapping the switch in the first state.

Another alternate embodiment for the flow switch mechanism is to use a two-state flow switch that is driven between states by pilot pressure and contains a special detent design to prevent sticking in intermediate positions. This embodiment has a closed hydraulic system comprised of an auxiliary pump, a flow switch, a plurality of sensors, a plurality of control chambers, the working fluid sub-chambers, and passageways. The passageways extend from the auxiliary pump to the flow switch, from the flow switch to the sensors, and from the flow switch to the working fluid sub-chambers. The control chambers and the working fluid sub-chambers are connected to the appropriate sensors. The auxiliary pump, which can be a piston pump, gear pump, centrifugal pump or any type of pump that produces the required flow rates and pressures, provides inlet and outlet flows of working fluid. The flow switch is connected to the inlet and to the outlet of the auxiliary pump and to two sets of working fluid sub-chambers, each set comprising roughly equal displacement.

The flow switch has two states. In the first state, the inlet of the auxiliary pump is connected to one set of working fluid sub-chambers, and the outlet of the auxiliary pump is connected to the other set of working fluid sub-chambers. In the second state, the switch connects the set of working fluid sub-chambers previously connected to the input of the auxiliary pump, to the outlet of the auxiliary pump, and connects the input of the auxiliary pump to the set of working fluid sub-chambers previously connected to the output of the auxiliary pump.

The flow switch is driven between states by pilot pressure controlled by the sensors. The flow switch has a spring operated detent and two pilot ports. When sufficient pilot pressure is applied to the first pilot port, the flow switch shifts to the first state. When sufficient pilot pressure is applied to the second port, the flow switch shifts to the second state. The spring detent is an "over center" type detent. An "over center" detent is a detent such that if the valve shifts incompletely, it will return to the detent position by spring pressure. The detent positions are located at the two extreme positions of the flow switch travel, which correspond to the two flow switch states. The detents are set up so that as the valve moves from one detent to the other, the detent spring is compressed during approximately the first half of the flow switch motion, and the spring is released during the second half. The nature of the detent is such that if the flow switch is at any point travel, and the pilot pressure is eliminated, the valve will move under the influence of the detent spring to a detent position; the first detent position if the flow switch is in the first half of the stroke, and the second detent position if the flow switch is in the second half of the stroke.

The sensor will shift when sufficient pressure exists between the working fluid sub-chamber and the matching control chamber. When the sensor on one of the working fluid sub-chambers shifts, it connects the output of the auxiliary pump or the working fluid sub-chamber to the pilot port. The output of the auxiliary pump or the active working fluid sub-chamber produces sufficient pressure to shift the flow switch. Once the flow switch has switched, the differential pressure between the working fluid sub-chamber and the matching control chamber is eliminated, the control shifts to the rest position, which is attached to the input of the auxiliary pump (low pressure). When the sensor on the opposed working fluid sub-chambers shifts, it connects the output of the auxiliary pump or the opposed working fluid sub-chamber to the pilot port. The output of the auxiliary pump or the working fluid sub-chamber produces sufficient pressure to shift the flow switch. Once the flow switch has switched, the differential pressure between the working fluid sub-chamber and the matching control chamber is eliminated, the sensor shifts to the rest position, which is attached to the input of the auxiliary pump (low pressure). The working fluid sub-chambers alternate between states, producing the pumping action.

Another alternate embodiment for the flow switch mechanism is to use two prime movers and two auxiliary pumps that are both connected to the closed hydraulic system and operate in opposite directions. The closed hydraulic system comprises 2 auxiliary pumps, a plurality of sensors, a plurality of control chambers, the working fluid sub-chambers, and passageways. The passageways extend from the auxiliary pumps to the sensors, and from auxiliary pumps to the working fluid sub-chambers. The control chambers and the working fluid sub-chambers are connected to the appropriate sensors. The auxiliary pumps, which can be a piston pump, gear pump, centrifugal pump or any type of pump that produces the required flow rates and pressures, provides inlet and outlet flows of working fluid. A prime mover is connected to each of the auxiliary pumps. The prime mover is a motor that can be driven mechanically, electrically or hydraulically. Each auxiliary pump is connected to both sets of working fluid sub-chambers. Each sets of working fluid sub-chambers comprises roughly equal displacement. The first auxiliary pump, when activated, fills the first working fluid sub-chamber and empties the second working fluid sub-chamber. The second auxiliary pump, when activated, empties the first working fluid sub-chamber and fills the second working fluid sub-chamber.

A sensor is used to sense when the working fluid sub-chamber is ready to switch. The sensor can be activated hydraulically or electrically, and can sense differential pressure, the proximity of the diaphragm or any other physical characteristic indicating the working fluid sub-chamber is ready to switch. Differential pressure may be sensed between the working fluid sub-chamber and the matching control chamber. The sensor activates the appropriate prime mover and de-activates the other. When the pump is at the other extreme position, and the opposite working fluid sub-chamber is sensed, the sensor activates the opposite prime mover and deactivates the other. In this way, the pump cycles between states and achieves the pumping action.

To prevent the deactivated auxiliary pump and prime mover from acting like a fluid powered motor when the activated pump is running, a one-way clutch or check valve is used to prevent rotation in the non-powered direction.

Another alternate embodiment of the switch uses a reversing clutch to reverse the direction of rotation of the auxiliary pump. The closed hydraulic system comprises an auxiliary pump, a sensor or sensors, a plurality of control chambers, the working fluid sub-chambers, and passageways. The passageways extend from the auxiliary pump to the working fluid sub-chambers, from the working fluid sub-chambers to the sensor(s), and from the control chambers to the sensors. The auxiliary pump, which can be a piston pump, gear pump, centrifugal pump or any type of pump that produces the required flow rates and pressures, provides inlet and outlet flows of working fluid. The inlet and to the outlet of the auxiliary pump are connected to the two sets of working fluid sub-chambers, each set comprising roughly equal displacement.

The prime mover is a motor that converts mechanical, pneumatic, electrical or hydraulic power to rotary motion. The prime mover is attached to the input shaft of the auxiliary pump through a reversing clutch that is capable of reversing the output direction of rotation from the prime mover. The prime mover rotates in a constant direction, the output shaft of the reversing clutch will transmit that rotation in the same or opposite direction based on a control signal. The auxiliary pump is a bi-directional hydraulic pump, the direction of flow is dependant on the direction of rotation of the input shaft. For example, a counter clockwise rotation produces an output on the left port, and input on the right, while a clockwise rotation produces the opposite. The pump is reversed by operating the reversing clutch to reverse the direction of flow from the auxiliary pump to the working fluid sub-chambers.

The reversing clutch is operated by mechanical, electrical or hydraulic means when the sensor indicates the pump has reached the end of the pumping stroke. The sensor can detect the end of the pumping stroke by differential pressure between the working fluid sub-chamber and the matching control chamber, or by contact, pressure or other appropriate sensing methods that determines the position of the pumping diaphragm.

For all embodiments disclosed and claimed herein, the auxiliary pump is driven by a prime mover that can be an AC or DC rotary electric motor, an AC or DC linear motor, a hydraulic motor or mechanical actuation from the surface. In the preferred embodiment of the invention, the prime mover is contained in the same housing as the pump, and is powered electrically. The pump may be connected to the motor in such a way that they share a common fluid supply, that is the same fluid is used in the electric motor as is used as the working fluid in the pump. In this arrangement, the fluid input of the auxiliary pump is connected to the electric motor fluid volume. This arrangement has the advantage of reducing the possibility of failure due to working fluid leakage around shaft seals, because the shaft seal between the pump and the motor is eliminated, which results in no moving seals between the working fluid and the well fluid. The fluid in the electric motor volume and working fluid in the closed hydraulic system in the pump expand and contract with temperature and pressure and must be equalized with the pump inlet to prevent pump and/or electric motor failure. Because the electric motor volume and the closed hydraulic system in the pump constitute one fluid volume, the working fluid sub-chambers compensate for this expansion and contraction for both the electric motor volume and the closed hydraulic system in the pump, eliminating the need for a separate expansion compensation for each volume.

DETAILED DESCRIPTION OF THE PREFERRED EMBODIMENTS

Figure 1:
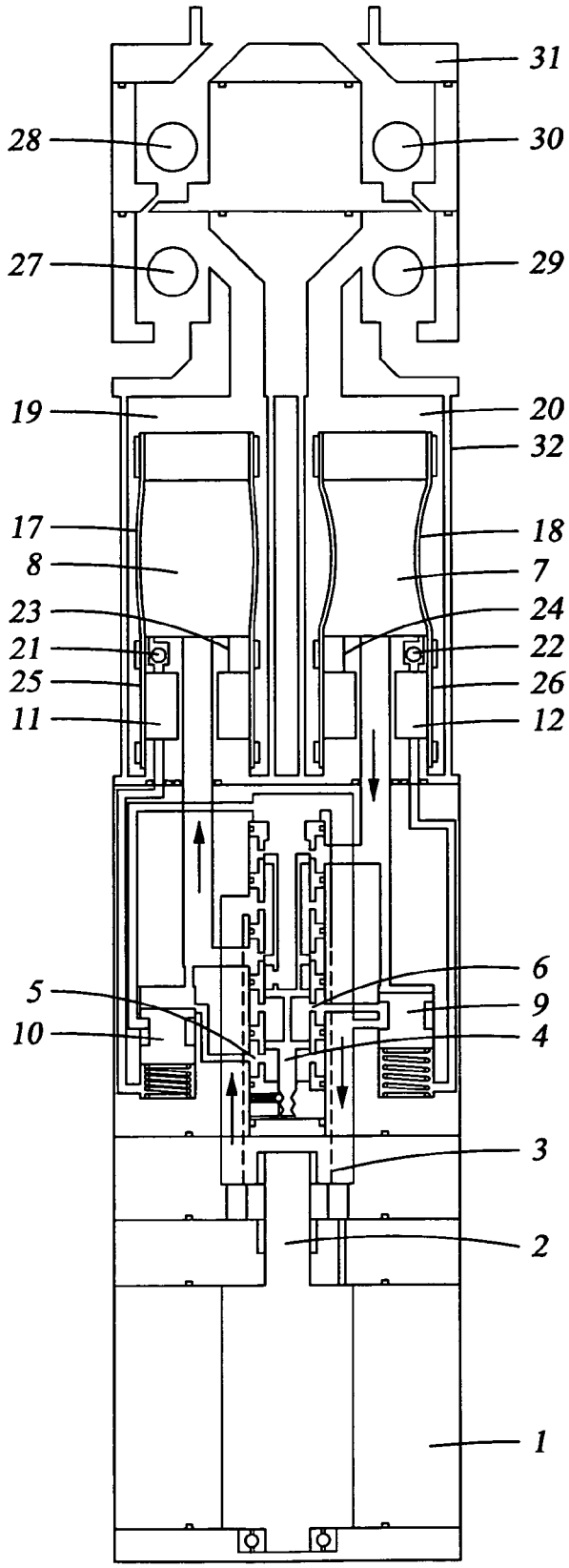
FIG. 1 is a cross section of the diaphragm pump of this invention illustrating the preferred embodiment of the flow switch that uses a flow switch driven both directions by pilot pressure.

Referring to FIG. 1, the first preferred embodiment of the diaphragm pump uses a prime mover (1) to supply mechanical energy to operate pump mechanism. The prime mover can be an electric motor, hydraulically actuated motor or mechanically actuated motor. The preferred embodiment uses a Franklin electric "Stripper" series motor that is designed of oil and gas applications. The motor is oil filled, 3-phase, 2-pole, 3450 Synchronous AC. The motor is typically 3¾" in diameter and several feet long. In the preferred embodiment, any free volume located inside the prime mover is filled with working fluid. The preferred working fluid is 10-weight mineral oil.

The prime mover attaches to the auxiliary pump with a coupling (2). The coupling transmits torque from the prime mover (1) to the auxiliary pump (3).

The auxiliary pump (3) produces a flow of working fluid under pressure, converting mechanical rotational energy to hydraulic power. A gear pump is used in the preferred embodiment. The preferred gear pump is the Haldex Barnes GC series. The auxiliary pump (3) is located between the coupling (2) and the flow switch (4).

The auxiliary pump (3) is engaged to a closed hydraulic system that consists of the auxiliary pump (3), the free volume of the electric motor (1), the flow switch (4), the working fluid sub-chambers (7,8), the sensors (9,10), and the control chambers (11,12).

The flow switch (4) controls the flow of working fluid between the working fluid sub-chambers (7,8) and the auxiliary pump (3). The flow switch (4) has two states.

For the first preferred embodiment, there are two alternate embodiments of the flow switch (4). In the first alternate embodiment for the flow switch, the sensors (9,10) produce a positive pressure pilot output when activated, otherwise, the sensors (9,10) produce a zero pressure output by being connected to the return side of the auxiliary pump (3). The sensors are connected to the two flow switch (4) pilot ports (5,6) such that, that when the port is pressurized with working fluid from the appropriate sensor (9 or 10), the flow switch (4) will shift to reverse the flow of working fluid to the working fluid sub-chambers (7,8). The preferred flow switch for this embodiment is Sun model DCDD-XXN.

Figure 2:
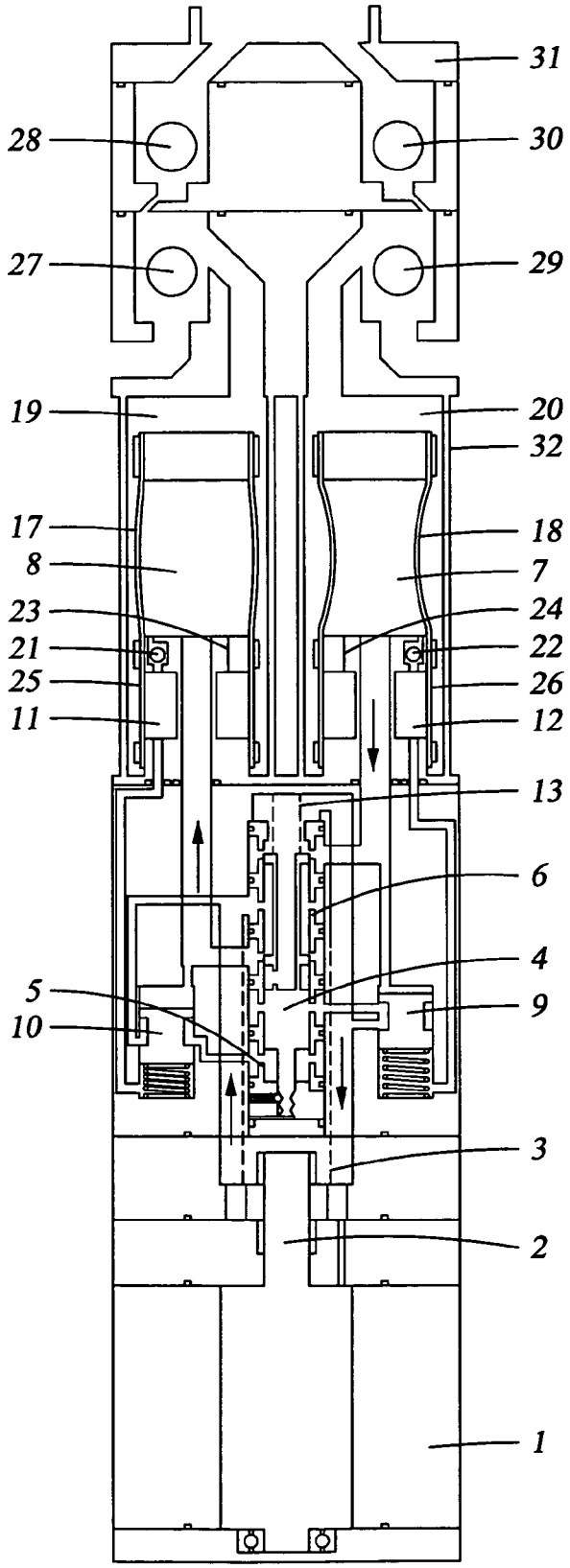
FIG. 2 is a schematic diagram illustrating an alternate flow switch configuration for the preferred embodiment of the invention that uses a flow switch driven one direction by pilot pressure, and returns by spring force.

In the second alternate embodiment for the flow switch, in FIG. 2, one sensor (10) produces a positive pressure pilot output when activated, the second sensor (9) produces a zero pressure output when activated by being connected to the return side of the auxiliary pump (3). The sensors are connected to a switch pilot port (5) such that, when the port is pressurized with working fluid from one sensor (10), the flow switch (4) will shift to reverse the flow of working fluid to the working fluid sub-chambers (7,8). When the other sensor (9) is activated, it connects the switch pilot port (5) to the suction side of the auxiliary pump (3), relieving the pressure in port, causing the flow switch (4) to return to the first position under the influence of a spring return (13) in the flow switch (4). The preferred flow switch for this alternate embodiment is Sun model DCDF-XXN.

Referring to FIG. 1, the flow switch (4) receives the flow of working fluid to and from the auxiliary pump (3) and directs the flow of working fluid from the auxiliary pump (3) to one of the working fluid sub-chambers (7), and the flow of working fluid from the opposite working fluid sub-chamber (8) to the auxiliary pump (3). The flow switch (4) has two states, one where the first working fluid sub-chamber (7) receives flow from the auxiliary pump (3) and where the auxiliary pump (3) receives flow from the second working fluid sub-chamber (8), and a second state where the auxiliary pump receives flow from the first working fluid sub-chamber (7) and the second working fluid sub-chamber (8) receives flow from the auxiliary pump.

Figure 3:
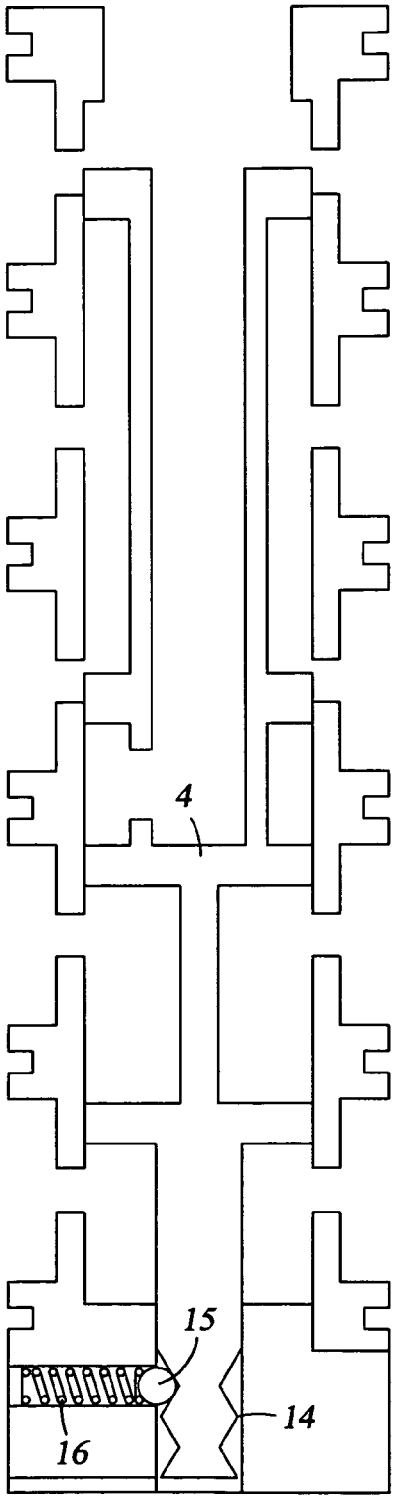
FIG. 3 is a cross section of the detent of the flow switch for the preferred embodiment.

The flow switch (4) has a spring-operated detent. Referring to FIG. 3, the switch spring detent has been modified to become an "over center" type detent by the use of a "mountain" shaped cam (14). This cam (14) is connected to the flow switch (4). This is an "over center" type detent designed so that one or more detent balls (15) and one or more detent springs (16) will store energy so that if the valve shifts incompletely, it will return to the detent position by spring pressure. The detent positions are located at the two extreme positions of the flow switch travel, which correspond to the two switch states. The detents are set up so that as the valve moves from one detent position to the other, one or more detent springs (16) are compressed during approximately the first half of the switch motion, and one or more springs (16) are released during the second half. One or more detent-balls (15) reduce friction and transmit the force between one or more springs (16) and the cam (14). The nature of the detent is such that if the flow switch is at any point in its travel, and the actuation force is eliminated, the flow switch (4) will move under the influence of the detent spring (16) to a detent position; the first detent position if the flow switch is in the first half of the stroke, and the second detent position if the flow switch is in the second half of the stroke.

Referring to FIG. 1, the state of the flow switch (4) is determined by sensors (9,10). The sensors (9,10) determine the state of the working fluid sub-chambers (7,8) and can have an electrical, mechanical or hydraulic output. Two sensors are typically used, one for each sub-chamber. The preferred sensor determines the pressure difference between the working fluid sub-chamber (7,8) and the matching control chamber (11,12), and when that difference exceeds a threshold, a signal is sent to the flow switch (4) to change the state of the flow switch (4). It should be noted that the sensor must have hysterisis in most cases to make sure the switching event is completed before the sensor output is eliminated. The preferred output of the sensor is a pilot pressure used to operate the flow switch. The preferred sensor is Sun Model DPBO-LEN.

The control chambers (11,12) are chambers filled with working fluid separated from the pumped fluid sub-chamber (19,20) by a flexible diaphragm (17,18). The preferred flexible diaphragm material is fabric reinforced nitrile rubber. One control chamber is located in each pumped fluid sub-chamber. The pressure of the working fluid in the control chamber is at exactly the same pressure as the pressure of the pumped fluid sub-chamber. In the preferred embodiments, a check valve (21,22) and orifice (23,24) is used in parallel between each working fluid sub-chamber and the matching control chamber to maintain the fill of fluid in the control chamber.

The working fluid sub-chambers (7, 8) are chambers filled with working fluid, where at least one boundary of the chamber is in communication through the flexible diaphragm (25, 26) with the pumped fluid sub-chamber (19, 20). The preferred material for the flexible diaphragm is fabric reinforced nitrile rubber. In the preferred embodiments, 2 identical chambers are used. The flow of working fluid to and from the working fluid sub-chambers (7, 8) is supplied from the flow switch (4). The pumped fluid sub-chambers (19, 20) are chambers filled with pumped fluid, separated from the working fluid sub-chambers (7, 8) and the control chambers (11, 12) by a flexible diaphragm (17,18,25,26). The pumped fluid sub chambers, working fluid sub-chambers, and the control chambers comprise a fixed volume defined by the check valves (27,28,29,30) and the housing (32).

Check valves (27,28,29,30) allow the unidirectional flow of pumped fluid into and out of the pumped fluid sub-chambers. Check valves 27 and 29; allow flow of well fluid into each pumped fluid sub-chamber from the wellbore. Check valves 28 and 30, allow the flow of pumped fluid from the pumped fluid sub-chambers (19,20) to the pump outlet, which is connected to the surface. In the preferred embodiment, the check valves (27,28,29,30) are standard sucker rod ball and seats, typically Harbison-Fisher 1½ inch ball, seats and cages.

Figure 4:
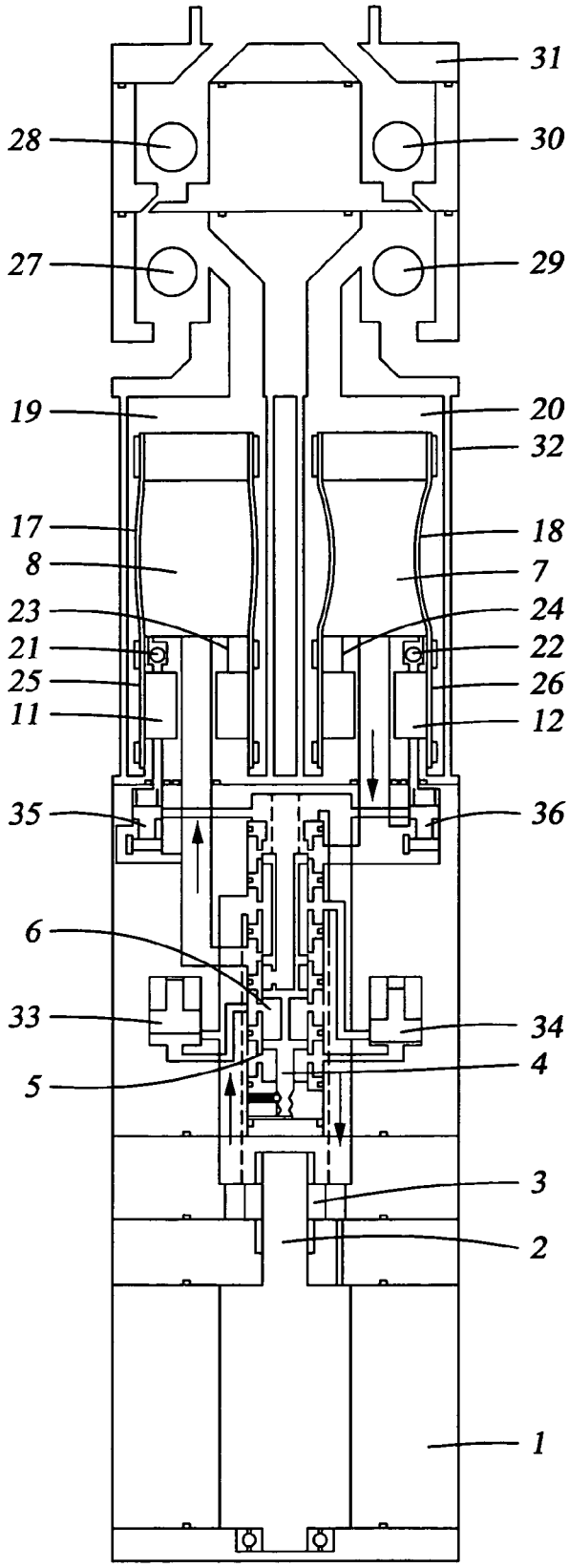
FIG. 4 is a cross section of the diaphragm pump of this invention illustrating a second embodiment of the flow switch in which the switching is driven in response to timing signals.

Referring to FIG. 4, the second preferred embodiment of the diaphragm pump uses a prime mover (1) to supply mechanical energy to operate pump mechanism. The prime mover can be can be an electric motor, hydraulically actuated motor or mechanically actuated motor. The preferred embodiment uses a Franklin electric "Stripper" series motor that is designed of oil and gas applications. The motor is an oil-filled, 3-phase, 2-pole, 3450 Synchronous AC. The motor is typically 3¾" in diameter and several feet long. In the preferred embodiment, any free volume located inside the prime mover is filled with working fluid. The preferred working fluid is 10-weight mineral oil.

The prime mover (1) attaches to the auxiliary pump with a coupling (2). The coupling transmits torque from the prime mover (1) to the auxiliary pump (3).

The auxiliary pump (3) produces a flow of working fluid under pressure, converting mechanical rotational energy to hydraulic power. A gear pump is used in the preferred embodiment. The preferred gear pump is the Haldex Barnes GC series. The auxiliary pump (3) is located between the coupling (2) and the flow switch (4).

The auxiliary pump (3) is engaged to a closed hydraulic system that consists of the auxiliary pump (3), the free volume of the electric motor (1), the flow switch (4), the working fluid sub-chambers (7,8), the timers (33,34), and the control chambers (11,12).

The flow switch (4) controls the flow of working fluid between the working fluid sub-chambers (7,8) and the auxiliary pump (3). The flow switch (4) has two states.

The timers (33,34) produce a positive pressure pilot output when activated, otherwise, the timers (33,34) produce a zero pressure output by being connected to the return side of the auxiliary pump (3). The timers are connected to the two flow switches (4) pilot ports (5,6) such that, when the port is pressurized with working fluid from the appropriate timer (33 or 34), the flow switch (4) will shift to reverse the flow of working fluid to the working fluid sub-chambers (7,8). The preferred flow switch for this embodiment is Sun model DCDD-XXN.

The flow switch (4) receives the flow of working fluid to and from the auxiliary pump (3) and directs the flow of working fluid from the auxiliary pump (3) to one of the working fluid sub-chambers (7), and the flow of working fluid from the opposite working fluid sub-chamber (8) to the auxiliary pump (3). The flow switch (4) has two states, one where the first working fluid sub-chamber (7) receives flow from the auxiliary pump (3) and where the auxiliary pump (3) receives flow from the second working fluid sub-chamber (8), and a second state where the auxiliary pump receives flow from the first working fluid sub-chamber (7) and the second working fluid sub-chamber (8) receives flow from the auxiliary pump.

The state of the flow switch (4) is determined by timers (33,34). The timers (33,34) can have an electrical, mechanical or hydraulic output. Two timers are typically used. The preferred timer provides a pressure pulse output after a fixed amount of time to activate the flow switch (4). It should be noted that the timer must have sufficient output duration to assure the flow switch is completely switched. The preferred timing device is a 555 electrical timer connected to an electrically actuated solenoid valve. Electrical timers are preferred for precise output, but hydraulic timing devices ate well known in the art and would also be preferred.

To assure that the flexible diaphragms (17,18) are not damaged by excessive pressure when the timing cycles are being established, the pump is provided with two pressure relief valves (35,36), one for each working fluid sub-chamber (7,8). The pressure relief valves monitor the pressure between the working fluid sub-chambers and the matching control chamber (11 or 12), and when that pressure exceeds a predetermined set point (typically 25 PSI), a relief valve (35 or 36) will open, allowing the flow of working fluid from a working fluid sub-chamber (7 or 8) to the suction side of the auxiliary pump (3). Sun model RVCD-LDN is the preferred relief valve.

The control chambers (11,12) are chambers filled with working fluid separated from the pumped fluid sub-chamber (19,20) by a flexible diaphragm (17,18). The preferred flexible diaphragm material is fabric reinforced nitrile rubber. One control chamber is located in each working fluid sub-chamber. The pressure of the working fluid in the control chamber is at exactly the same pressure as the pressure of the pumped fluid sub-chamber (19 or 20). In the preferred embodiments, a check valve (21,22) and orifice (23,24) is used in parallel between each working fluid sub-chamber and the matching control chamber to maintain the fill of fluid in the control chamber.

The working fluid sub-chambers (7, 8) are chambers filled with working fluid, where at least one boundary of the chamber is in communication through the flexible diaphragm (17,18) with the pumped fluid sub-chamber (19, 20). The preferred material for the flexible diaphragm is fabric reinforced nitrile rubber. In the preferred embodiments, 2 identical chambers are used. The flow of working fluid to and from the working fluid sub-chambers (7, 8) is supplied from the flow switch (4). The pumped fluid sub-chambers (19,20) are chambers filled with pumped fluid, separated from the working fluid sub-chambers (7,8) and the control chambers (11,12) by a flexible diaphragm (17,18,25,26). The pumped fluid sub chambers, working fluid sub-chambers, and the control chambers comprise a fixed volume defined by the check valves (27,28,29,30) and the housing (32).

Check valves (27,28,29,30) allow the unidirectional flow of pumped fluid into and out of the pumped fluid sub-chambers. Check valves 27 and 29; allow flow of well fluid into each pumped fluid sub-chamber from the wellbore. Check valves 28 and allow the flow of pumped fluid from the pumped fluid sub-chambers (19,20) to the pump outlet (31), which is connected to the surface. In the preferred embodiment, the check valves (27,28,29,30) are standard sucker rod ball and seats, typically Harbison-Fisher 1½ inch ball, seats and cages.

Figure 5:
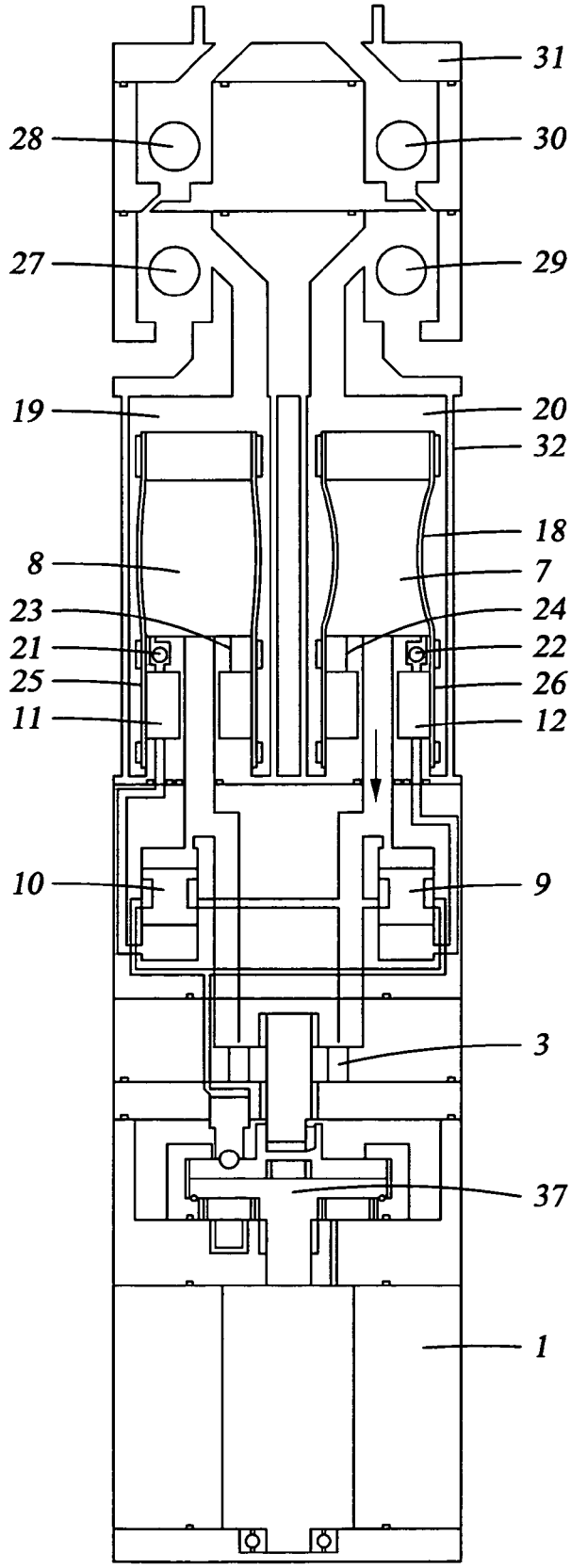
FIG. 5 is a cross section of the diaphragm pump of this invention illustrating a third embodiment of the flow switch that uses a reversing clutch in place of the valve of the first preferred embodiment.
Figure 6:
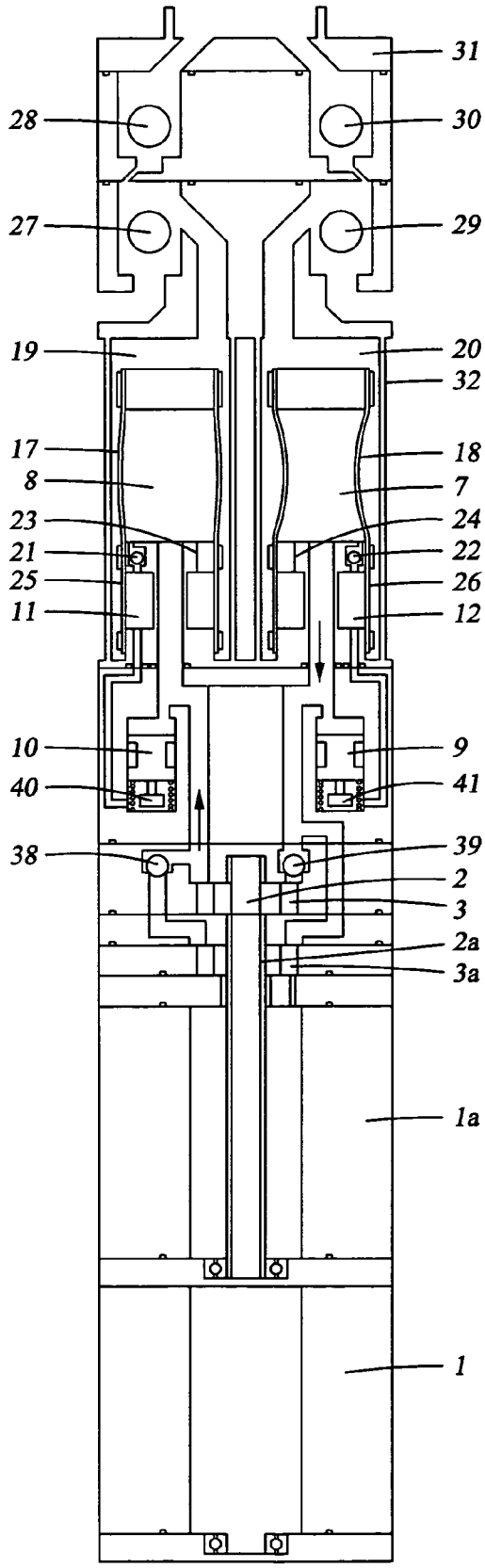
FIG. 6 is a cross section of the diaphragm pump of this invention illustrating a fourth preferred embodiment of the flow switch that uses dual motors/auxiliary pumps in place of the valve of the first preferred embodiment.

Referring to FIG. 5, the third preferred embodiment of the diaphragm pump is shown. This of the third preferred embodiment uses a prime mover (1) to supply mechanical energy to operate pump mechanism. The alternate embodiment of the third preferred embodiment shown in FIG. 6 uses two identical prime movers (1 and 1*a*). The prime mover(s) can be can be an electric motor, hydraulically actuated motor or mechanically actuated motor. The preferred embodiment uses a Franklin electric "Stripper" series motor that is designed of oil and gas applications. The motor is an oil-filled, 3-phase, 2-pole, 3450 Synchronous AC. The motor is typically 3¾" in diameter and several feet long. In the preferred embodiment, any free volume located inside the prime mover is filled with working fluid. The preferred working fluid is 10-weight mineral oil.

The prime mover (1) attaches to the auxiliary pump with a reversing clutch (37). The alternate embodiment uses two auxiliary pumps (3 and 3*a*) and two couplings (2 and 2*a*). The couplings(2 and 2*a*) or the reversing clutch (37) transmits torque from the prime mover(s) (1,1*a*) to the auxiliary pump(s) (3).

The auxiliary pump or pumps (3, 3*a*) produces a flow of working fluid under pressure, converting mechanical rotational energy to hydraulic power. A gear pump is used in the preferred embodiment. The preferred gear pump is the Haldex Barnes GC series. The auxiliary pump (3) is located between the reversing clutch (2) and working fluid sub chambers (7,8).

The alternate embodiment uses two auxiliary pumps (3 and 3*a*), connected to the working fluid sub-chambers (7,8). Working fluid from the first auxiliary pump (3) flows to first working fluid sub-chamber (7) and from the second working fluid sub-chamber (8). Working fluid from the second auxiliary pump (3*a*) flows to the second working fluid sub-chamber (8) and to the first working fluid sub-chamber (7). Check valves (38,39) prevent flows in the reverse direction.

The auxiliary pump(s) (3, 3*a*) is engaged to a closed hydraulic system that consists of the auxiliary pump(s) (3,3*a*), the free volume of the electric motor(1), the working fluid sub-chambers (7,8), the sensors (9,10), and the control chambers (11,12).

The flow switch is operated by selecting the direction of the reversing clutch (37) or in the alternate embodiment, the selection of the active prime mover (1 or 1*a*) under the control of the sensors (9,10). The sensors (9,10) determine the state of the working fluid sub-chambers (7,8) and can have an electrical, mechanical or hydraulic output. Two sensors are typically used, one for each sub-chamber. The preferred sensor determines the pressure difference between the working fluid sub-chamber (7,8) and the matching control chamber (11,12), and when that difference exceeds a threshold, a signal is sent to the reversing clutch (37) to change the direction of the reversing clutch (37). In the alternate embodiment, the sensors (9,10), when activated, will deactivate the active prime mover (1 or 1*a*) and activate the other prime mover (1 or 1*a*). It should be noted that the sensor must have hysterisis in most cases to make sure the switching event is completed before the sensor output is eliminated. The preferred output of the sensor is a pilot pressure to operate the reversing clutch or activate electrical switches (40,41) in the alternate embodiment. The preferred sensor is Sun Model DPBO-LEN.

The control chambers (11,12) are chambers filled with working fluid separated from the pumped fluid sub-chamber (19,20) by a flexible diaphragm (17,18). The preferred flexible diaphragm material is fabric reinforced nitrile rubber. One control chamber is located in each working fluid sub-chamber. The pressure of the working fluid in the control chamber is at exactly the same pressure as the pressure of the pumped fluid sub-chamber (19,20). In the preferred embodiments, a check valve (21,22) and orifice (23,24) is used in parallel between each working fluid sub-chamber and the matching control chamber to maintain the fill of fluid in the control chamber.

The working fluid sub-chambers (7, 8) are chambers filled with working fluid, where at least one boundary of the chamber is in communication through the flexible diaphragm (17,18) with the pumped fluid sub-chamber (19, 20). The preferred material for the flexible diaphragm is fabric reinforced nitrile rubber. In the preferred embodiments, 2 identical chambers are used. The flow of working fluid to and from the working fluid sub-chambers (7,8) is supplied from auxiliary pump(s) (3,3*a*). The pumped fluid sub-chambers (19,20) are chambers filled with pumped fluid, separated from the working fluid sub-chambers (7,8) and the control chambers (11,12) by a flexible diaphragm (17,18, 25,26). The pumped fluid sub chambers, working fluid sub-chambers, and the control chambers comprise a fixed volume defined by the check valves (27,28,29,30) and the housing (32).

Check valves (27,28,29,30) allow the unidirectional flow of pumped fluid into and out of the pumped fluid sub-chambers. Check valves 27 and 29; allow flow of well fluid into each pumped fluid sub-chamber from the wellbore. Check valves 28 and 30, allow the flow of pumped fluid from the pumped fluid sub-chambers (19,20) to the pump outlet (31), which is connected to the surface. In the preferred embodiment, the check valves (27,28,29,30) are standard sucker rod ball and seats, typically Harbison-Fisher 1½ inch ball, seats and cages.

These preferred embodiments with alternate preferred embodiments are specific combinations of features that illustrate the principles involved to solve the problem of the flow switch sticking in hydraulically actuated diaphragm pumps. Those skilled in the art can envision combinations of features, for example, electronic sensing combined with the reversing clutch, that have not been specifically covered in the preferred embodiment but are disclosed in this specification and claimed in the claims that follow.

What is claimed is:

1. A submersible well pumping system comprising:

a) an axially elongated housing having a diameter less than the diameter of a bore hole of a well;

b) a plurality of rigid pumping chambers formed in the housing and enclosing pumping fluid and working fluid in fixed volumes;

c) flexible diaphragm means dividing each pumping chamber into two sub-chambers thus separating the pumped fluid from the working fluid;

d) pump inlet means connecting the pumped fluid sub-chambers and the bore hole of the well;

e) pump outlet means connecting the pumped fluid sub-chambers and the surface of the earth;

f) an inlet check valve means per pumped fluid sub-chamber extending between the pump inlet and each pumped fluid sub-chamber allowing unidirectional flow of pumped fluid from the pump inlet means to the pumped fluid sub-chambers;

g) outlet check valve means extending from the pump outlet means to each pumped fluid sub-chamber allowing the unidirectional flow of pumped fluid from the pumped fluid sub-chambers to the pump outlet means;

h) a closed hydraulic system filled with working fluid;

i) at least one auxiliary pump capable of circulating working fluid through the closed hydraulic system;

j) a two-state flow switch engaged to the closed hydraulic system, extending between the auxiliary pump or pumps and the working fluid sub-chambers capable of alternately inserting and simultaneously withdrawing working fluid into the working fluid sub-chambers;

k) a switching actuation means to reverse the state of the flow switch;

l) a plurality of control chambers, comprising volumes of working fluid and located in the vicinity of matching pumped fluid and working fluid sub-chambers, having rigid boundaries except where separated from the pumped fluid sub-chamber by a flexible diaphragm;

m) a plurality of sensors, each connected to the switching actuation means and to the appropriate working fluid sub-chamber and control chamber;

n) means to insure the flow switch is completely actuated;

o) a plurality of fluid passageways extending from the auxiliary pump to the flow switch, from the flow switch to the sensors and from the flow switch to the working fluid sub-chambers; and p) prime moving means attached to one or more auxiliary pumps and driving one or more auxiliary pumps.

2. A well pumping system according to claim 1 wherein the flow switch comprises a two state valve with two control ports driving the flow switch between states via pilot pressure.

3. A well pumping system according to claim 1 wherein the flow switch comprises a two-state valve with a single control port driving the flow switch to one state, via pilot pressure and a spring driving the flow switch to the other state when the pressure in the control port is removed.

4. A well pumping system according to claim 1 wherein the flow switch comprises a reversing clutch between the auxiliary pump and the prime mover.

5. A well pumping system according to claim 1 wherein the flow switch comprises a two-state valve and a single relief valve per working fluid sub-chamber.

6. A well pumping system according to claim 1 wherein the flow switch comprises the activation of one prime mover and the deactivation of another.

7. A well pumping system according to claim 1 wherein the means to insure the switch means is completely actuated comprises an over center type detent, said over center type detent being capable of preventing sticking of the flow switch in intermediate positions.

8. A well pumping system according to claim 1 wherein the switching actuation means is hydraulic pressure.

9. A well pumping system according to claim 1 wherein the switching actuation means is mechanical energy.

10. A well pumping system according to claim 1 wherein the switching actuation means is electrical energy.

11. A well pumping system according to claim 1 wherein the sensors produce output in response to differential hydraulic pressure.

12. A well pumping system according to claim 1 wherein the sensors produce output at regular time intervals.

13. A well pumping system according to claim 1 wherein the sensors have a hydraulic output.

14. A well pumping system according to claim 1 wherein the sensors have a mechanical output.

15. A well pumping system according to claim 1 wherein the sensors have an electrical output.

16. A well pumping system according to claim 1 wherein the prime moving means is a pneumatic motor.

17. A well pumping system according to claim 1 wherein the control chamber and the working fluid sub-chamber are located inside the pumping chamber.

18. A well pumping system according to claim 1 wherein the prime moving means is filled with working fluid.

19. A well pumping system according to claim 1 wherein the prime moving means is filled with prime mover fluid.

20. A well pumping system according to claim 1 wherein the prime moving means is located inside the housing.

21. A well pumping system according to claim 1 wherein the prime moving means is an electric motor located inside the housing.

22. A well pumping system according to claim 1 wherein the prime moving means is a hydraulic motor driven from the surface of the earth.

23. A well pumping system according to claim 1 wherein the prime moving means is a mechanically actuated motor driven from the surface of the earth.

24. A well pumping system according to claim 1 wherein the auxiliary pump is a positive displacement pump.

25. A well pumping system according to claim 1 wherein the prime mover fluid and the working fluid are connected by a fluid filled conduit, and the diaphragm means provides for the expansion of both the working fluid and the prime mover fluid.

26. A well pumping system according to claim 1 wherein the axially elongated housing is completely filled with working fluid and prime mover fluid, with the flexible diaphragm means in such an arrangements as to provide a seamless barrier with no moving seals.

27. A well pumping system according to claim 1 wherein the prime mover fluid is pressure-compensated to the pump inlet, and the working fluid in the axially elongated housing is pressure-compensated to the pump inlet such that pressures between the prime mover fluid and the working fluids are equalized.

28. A well pumping system according to claim 1 wherein the sensors are hydraulic timers.

29. A well pumping system according to claim 1 wherein the sensors are mechanical timers.

30. A well pumping system according to claim 1 wherein the sensors are electrical timers.

* * * * *